US008320817B2

(12) United States Patent
Zaretsky

(10) Patent No.: US 8,320,817 B2
(45) Date of Patent: Nov. 27, 2012

(54) CHARGE REMOVAL FROM A SHEET

(75) Inventor: Mark C. Zaretsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 206 days.

(21) Appl. No.: 12/858,767

(22) Filed: Aug. 18, 2010

(65) Prior Publication Data

US 2012/0045265 A1 Feb. 23, 2012

(51) Int. Cl.
*G03G 15/00* (2006.01)

(52) U.S. Cl. ..... 399/405; 399/45

(58) Field of Classification Search ..... 399/405, 399/45

See application file for complete search history.

(56) References Cited

U.S. PATENT DOCUMENTS

| | | | | |
|---|---|---|---|---|
| 3,470,417 | A | 9/1969 | Gibbons | |
| 3,730,753 | A | 5/1973 | Kerr | |
| 4,245,272 | A | 1/1981 | Rushing et al. | |
| 4,363,070 | A * | 12/1982 | Kisler | 361/212 |
| 4,486,808 | A | 12/1984 | Cardone | |
| 4,737,816 | A | 4/1988 | Inoue et al. | |
| 4,851,960 | A | 7/1989 | Nakamura et al. | |
| 4,914,737 | A | 4/1990 | Amemiya et al. | |
| 5,084,731 | A | 1/1992 | Baruch | |
| 5,132,737 | A | 7/1992 | Takeda | |
| 5,589,922 | A | 12/1996 | Amemiya | |
| 5,689,758 | A * | 11/1997 | Wataki et al. | 399/45 |
| 5,690,014 | A | 11/1997 | Larkin | |
| 5,890,046 | A | 3/1999 | Amemiya et al. | |
| 5,966,559 | A * | 10/1999 | May et al. | 399/45 |
| 6,048,119 | A * | 4/2000 | Kato et al. | 400/624 |
| 6,205,309 | B1 | 3/2001 | Gundlach et al. | |
| 6,831,818 | B2 * | 12/2004 | Dickhoff et al. | 361/18 |
| 7,227,735 | B2 | 6/2007 | Hasenauer | |
| 7,596,333 | B2 * | 9/2009 | Kasiske et al. | 399/67 |
| 2003/0202830 | A1 * | 10/2003 | Oh et al. | 399/390 |
| 2004/0179875 | A1 * | 9/2004 | Iwata et al. | 399/329 |
| 2006/0198668 | A1 * | 9/2006 | Tsujita | 399/315 |
| 2008/0317519 | A1 * | 12/2008 | You et al. | 399/302 |
| 2011/0044732 | A1 * | 2/2011 | You et al. | 399/308 |
| 2012/0099911 | A1 * | 4/2012 | Zaretsky et al. | 399/406 |

FOREIGN PATENT DOCUMENTS

| | | |
|---|---|---|
| JP | 60-029764 | 2/1985 |

* cited by examiner

*Primary Examiner* — David Gray
*Assistant Examiner* — G. M. Hyder
(74) *Attorney, Agent, or Firm* — Raymond L. Owens

(57) ABSTRACT

A method of removing charge from a charged sheet prior to stacking the charged sheet is disclosed. The method includes moving the charged sheet through a set of nipped rollers while a first roller has an AC voltage applied thereto so that a first side of the charged sheet is in contact with the first roller and has its charge substantially dissipated, whereby charge substantially remains on a second side of the charged sheet in contact with a second roller. The method further includes using at least one non-contact charge removal device to remove charge from the second side of the charged sheet, and stacking the discharged sheet.

13 Claims, 4 Drawing Sheets

CHARGE REMOVAL FROM A SHEET

FIELD OF THE INVENTION

The present invention relates to removing electrostatic charge from sheets prior to stacking in a hopper or tray.

BACKGROUND OF THE INVENTION

In electrophotographic reproduction apparatus and printers, an electrostatic latent image is formed on a photoconductor and developed into a visible image by bringing the photoconductor into close proximity or contact with charged toner. In a two-component developer, the toner becomes tribocharged and is attracted to the electrostatic latent image regions of the photoconductor.

After the electrostatic latent image on the photoconductor has been developed, the developed image is generally transferred to a receiver, such as a sheet of paper or transparency stock. This is generally accomplished by applying an electric field in such a manner to urge the toner from the photoconductor to the sheet. In some instances, it is preferable to first transfer the developed image from the photoconductor to an intermediate transfer member and then from the intermediate transfer member to the sheet. Again, this is commonly accomplished by applying an electric field to urge the developed image toward the intermediate transfer member for the first transfer and toward the sheet for the second transfer. For multi-color images, this process of creating an electrostatic latent image and developing the image typically occurs in separate electrophotographic (EP) modules, one for each color. The developed color separations are then either accumulated onto an intermediate transfer member or directly onto the sheet with multiple transfer steps, one for each color separation. Finally, the sheet bearing the transferred toner image is then passed through a fusing device to permanently affix the developed image to the sheet by heat and pressure.

The toner is typically a thermoplastic polymer that is electrically non-conductive. The process of transferring the developed image or images to the sheet results in a high level of electrostatic charge, in excess of 26 $\mu C/cm^2$ in magnitude, on the surfaces of the toned image and the sheet due to the deposition of charge on the back of the sheet of opposite polarity to the toner charge. This electrostatic charge will dissipate through a conductive sheet such as moisture-containing paper, but will not migrate through an insulative sheet such as transparency stock or papers containing insulative coatings or layers. The result is trapped electrostatic charge on the toned sheet. The trapped charge can inconvenience the user of the printed sheet, as they tend to stick together due to the electrostatic forces of attraction between the opposite polarity charges on the surfaces of adjacent sheets.

Several approaches to eliminating electrostatic charge on a moving surface of a web, cylinder, or sheet have been described in the prior art, including non-contact corona chargers, biased compliant roller chargers, and non-contacting electrically grounded devices.

U.S. Pat. No. 3,470,417 to Gibson discloses electrical conditioning of a moving dielectric web by gridded corona chargers located on opposing sides of the web, each corona charger energized by a DC voltage, which electrical conditioning can produce a predetermined potential on each face of the web and can also be used to neutralize substantially all charge on a web.

U.S. Pat. No. 3,730,753 to Kerr describes a method for removing a non-uniform charge distribution from a web that has previously been treated by an AC corona discharger for purpose of making the web coatable by an emulsion. The method involves flooding the corona discharge treated surface with negative charge by a high voltage negative DC non-gridded corona charger, followed by reducing the surface charge on the web to approximately zero by a high voltage positive DC non-gridded corona charger.

U.S. Pat. No. 4,245,272 to Rushing et al. discloses a so-called "boost and trim" corona charging method for charging a moving dielectric film or web, e.g., a photoconductor. The "boost" produces an overcharging of the photoconductor at the beginning of the process of charging a given area of the film, and the "trim" subsequently reduces this overcharge so as to give a predetermined exit voltage as the given area leaves the "boost and trim" charger. A "boost and trim" charger as described in U.S. Pat. No. 4,245,272 is a multiple open wire charger (no grid) with each wire energized by a DC-biased AC voltage source. Typically, an AC signal is applied in common to all wires of the charger, with a different DC potential applied to each wire. The waveform shape of the AC signal is not specified.

U.S. Pat. No. 4,486,808 to Cardone discloses an open-wire (no grid) corona charger energized by an AC voltage and located on one side of a dielectric web, and an open-wire DC-biased AC charger located on the other side of the dielectric web. The waveform shape of the AC voltage is not specified.

U.S. Pat. No. 4,737,816 to Inoue et al. discloses a detack charger assembly for neutralizing charges on a toned receiver member carried by a transport belt, which neutralizing permits the receiver member to be readily removed from the belt by a pawl. The detack charger assembly has two opposed corona chargers, and the toned receiver member on the transport belt is moved between them. Each of the chargers is energized by an AC voltage which include a DC offset, the AC voltages applied to the two chargers 180 degrees out of phase with one another. The waveform shape of each AC voltage is not specified. It is also briefly disclosed that a grid may be used on a charger to control the charging current.

U.S. Pat. No. 4,914,737 to Amemiya et al. discloses a corona discharge device used following a corona transfer member for transferring toner from a photoconductive primary imaging member to a receiver, the receiver supported by a dielectric sheet member during both transfer of the toner and during operation of the corona discharge device. The corona discharge device includes two single-wire, non-gridded corona chargers, i.e., an outer corona charger facing the toner on the front side of the receiver (after transfer of the toner from the primary imaging member to the receiver) and an inner corona charger facing the back side of the dielectric sheet member. An AC voltage is applied to both corona chargers, the AC voltages being out of phase with one another. The waveform shape of each AC voltage is not specified. An appropriate DC bias voltage may be applied to either or both of the outer and inner corona chargers.

U.S. Pat. No. 5,132,737 Takeda et al. discloses a pair of single-wire non-gridded corona dischargers (voltage excitation waveforms not specified) for post-transfer use with a dielectric carrying sheet supporting a toned transfer material such as paper, with one of the corona dischargers disposed facing the toned transfer material and the other corona discharger disposed facing the back side of the dielectric carrying sheet.

U.S. Pat. Nos. 5,589,922 and 5,890,046 to Amemiya et al. disclose opposed open-wire, non-gridded corona discharge devices, disposed similarly to the open-wire corona discharge devices of U.S. Pat. No. 4,914,737 to Amemiya, and similarly employing mutually out-of phase AC voltage waveforms including DC offsets, certain embodiments using plural corona wires. The AC waveform shapes are not specified.

A commercial corona discharger assembly for neutralizing static charges on both sides of a dielectric web is manufactured by HAUG GmbH of Leinfelden-Echterdingen, Germany. An AC Power pack (catalog number EN-70 LC) is used for energizing four "ionizing bars" (catalog number EI-RN), the ionizing bars mounted as two successive pairs, one ionizing bar of each pair disposed on either side of a dielectric web, each ionizing bar powered by an AC sinusoidal waveform such that the two waveforms of each pair are 180 degrees out of phase. No DC offset biases are specifically described, nor are grids included with the ionizing bars.

Several commercial electrophotographic printing machines (e.g., Xerox Docucolor 40, Ricoh NC 8015, Canon CLC 1000) employ an endless insulating transport belt for carrying receivers through multiple successive transfer stations so as to build up a multicolor toner image on each receiver, in which machines the endless transport belt, after detack of the receivers, is passed through a charging apparatus for neutralizing unwanted surface charges or for use as a pre-clean charging station prior to cleaning the transport belt. In a Xerox Docucolor 40, a pair of opposed single wire AC pre-clean corona chargers having metal shells and no grids are disposed on opposite sides of the transport belt, the chargers using square wave excitation at a frequency of about 1000 Hz. A Ricoh NC 8015 machine uses an open-wire AC charger on the front side of the transport belt, the charger opposed by a roller on the back side of the belt. The Canon CLC 1000 machine includes a detack station which detack station includes a DC-biased open-wire AC charger opposed by a roller, a post-detack roller nip having grounded rollers through which the transport web passes so as to even out the potential differences between frame and interframe areas, with the post-detack roller nip followed by a back-side web cleaner that also functions as a static charge eliminator.

U.S. Pat. No. 6,205,309 to Gundlach et al. discloses an AC corona charger wherein a corona wire is coupled through a capacitive connection to an AC voltage source, the corona wire partially surrounded by a conductive shield connected to a DC voltage source. The presence of a capacitance between the AC voltage source and the corona wire ensures that equal numbers of positive and negative corona ions are generated at the wire, with the DC potential controlling the net charging current, e.g., for purpose of charging a photoconductive member. It is inferred that by setting the DC potential close to zero, the charger may be used as a neutralizer.

Commonly assigned U.S. Pat. No. 7,227,735 to Hasenauer et. al. discloses a high voltage power supply for electrostatically discharging toned receiver from a sheet fed reproduction apparatus where a power regulation system charges corona wires and prevents arcing and overloading.

However, these non-contacting corona charger methods have several drawbacks including the need for very high AC voltages (in excess of 12 kV peak-to-peak), inefficient charge transfer from the device to the surface to be charged (typically less than 15%), significant space requirements for both the corona chargers and the high voltage cables to supply the power to the chargers, and the need for costly and space-consuming methods for mitigation of high levels of electromagnetic emissions (EMI) and corona by-products such as ozone and nitrous oxides.

U.S. Pat. No. 4,851,960 discloses a method for contact charging of a photosensitive member surface using a charged conductive roller. The conductive roller includes a metal core coated with either one or two layers of a static dissipative compliant material, such as rubber, urethane, or ethylene propylene diene monomer (EPDM). The metal core is connected to a high voltage power supply providing a non-zero DC voltage superposed on an AC voltage. The level of the DC voltage determines the resulting level of voltage on the photosensitive member surface, typically in the range of −250 to −1000 volts. The level of the AC peak-to-peak voltage is not less than twice the absolute magnitude of the DC voltage.

This contact charging method overcomes many of the objections of corona chargers as it is a compact, highly efficient charging method operating at significantly lower AC voltage levels, producing greatly reduced levels of EMI and corona by-products. However, this contact charging method uses a single roller electrically biased with a non-zero DC component for the purpose of applying a non-zero amount of surface charge onto a photosensitive member containing a grounded counter electrode located a distance below the surface of the photosensitive member.

U.S. Pat. No. 5,690,014 discloses a small diameter ionizing cord for removing static charge from an insulative material. The cord may be electrically grounded or connected to a charge source, and is spaced from the surface of the insulative material anywhere from 1 to 25 mm. For the case of a moving web or sheet, the axis of the cord is oriented to be parallel to the plane of the insulative material. This method is well suited to remove lower levels of surface charge associated with the net total charge of the insulative material, obtained by the addition of all charges located on either surface of the material, along with any bulk stored charge. However, this method cannot effectively remove high levels of surface charge associated with the condition of having charge of one polarity on one surface of the material, and charge of the opposite polarity on the other surface.

Even though the prior art provides different ways for removing charge from a moving web, cylinder, or sheet, none address the issue of removing high levels of electrostatic charge from both surfaces of a toned, insulative sheet electrically isolated from ground so as to prevent stacked sheets from becoming bonded together by electrostatic charge. If the sheets are bound together by charge after stacking they would have to be pulled apart, making it difficult to handle the sheets either by a customer or by other post-printing equipment such as a sorter. It is very important to be able to remove the charge on individual toned sheets prior to stacking to enable facile handling of the printed sheets. Moreover, none of the prior art provides a method of accomplishing this task in a compact, low cost, efficient manner that minimizes EMI and corona by-product production.

SUMMARY OF THE INVENTION

In accordance with the present invention there is provided a method of removing charge from a sheet prior to stacking the sheet, comprising:

a) moving the charged sheet through a set of nipped rollers while a first roller has an AC voltage applied thereto so that a first side of the charged sheet is in contact with the first roller and has its charge substantially dissipated, whereby charge substantially remains on a second side of the charged sheet in contact with a second roller;

b) after step (a) using at least one non-contact charge removal device to remove charge from the second side of the charged sheet; and c) stacking the discharged sheet.

It is an important feature of the present invention that a sheet bonding problem caused by excess charge is effectively solved by removal of charge from the sheet in a two step process, the first having a biased AC contact roller for removing charge from a first side of the sheet and the second having a non-contact charge removal device for removing charge from the second side of the sheet without having to change the materials within the sheet. An important advantage of the invention is that it is particularly suitable for use in electrophotographic arrangements where charged toner has been applied and fused to an insulative sheet. Applicant has recognized that by applying an AC bias to one side of a charged toned sheet effectively removes charge from that side of the sheet. After removing the charge from one side, the charge from the opposite side of a sheet can then be freely removed by a non-contacting charge removal device.

Removing charge using a biased AC roller is an efficient way to remove charge from a first side of the sheet and using a non-contact charge removal device is an efficient way to remove charge from the second side of the sheet. This provides a significant advantage for preventing stacked sheets from bonding together due to electrostatic charge.

These and other aspects, objects, features, and advantages of the present invention will be more clearly understood and appreciated from a review of the following detailed description of the preferred embodiments and appended claims, and by reference to the accompanying drawings.

DETAILED DESCRIPTION OF THE INVENTION

Removing the charge from an insulative sheet prior to stacking is an effective method to prevent the toned sheets from subsequently bonding to each other after being stacked. For example, when insulative sheets are printed upon using an electrophotographic printing process where charged toner particles are transferred and fused onto the sheet and the sheets are subsequently stacked, the stored surface charge on the insulative toned sheets causes the sheets to bond to one another, making it difficult to separate and handle the printed sheets. Because the bonding between the toned sheets is caused by the electrostatic charge on the sheets, this problem is effectively eliminated by removing such charge from the toned sheets.

Figure 1:
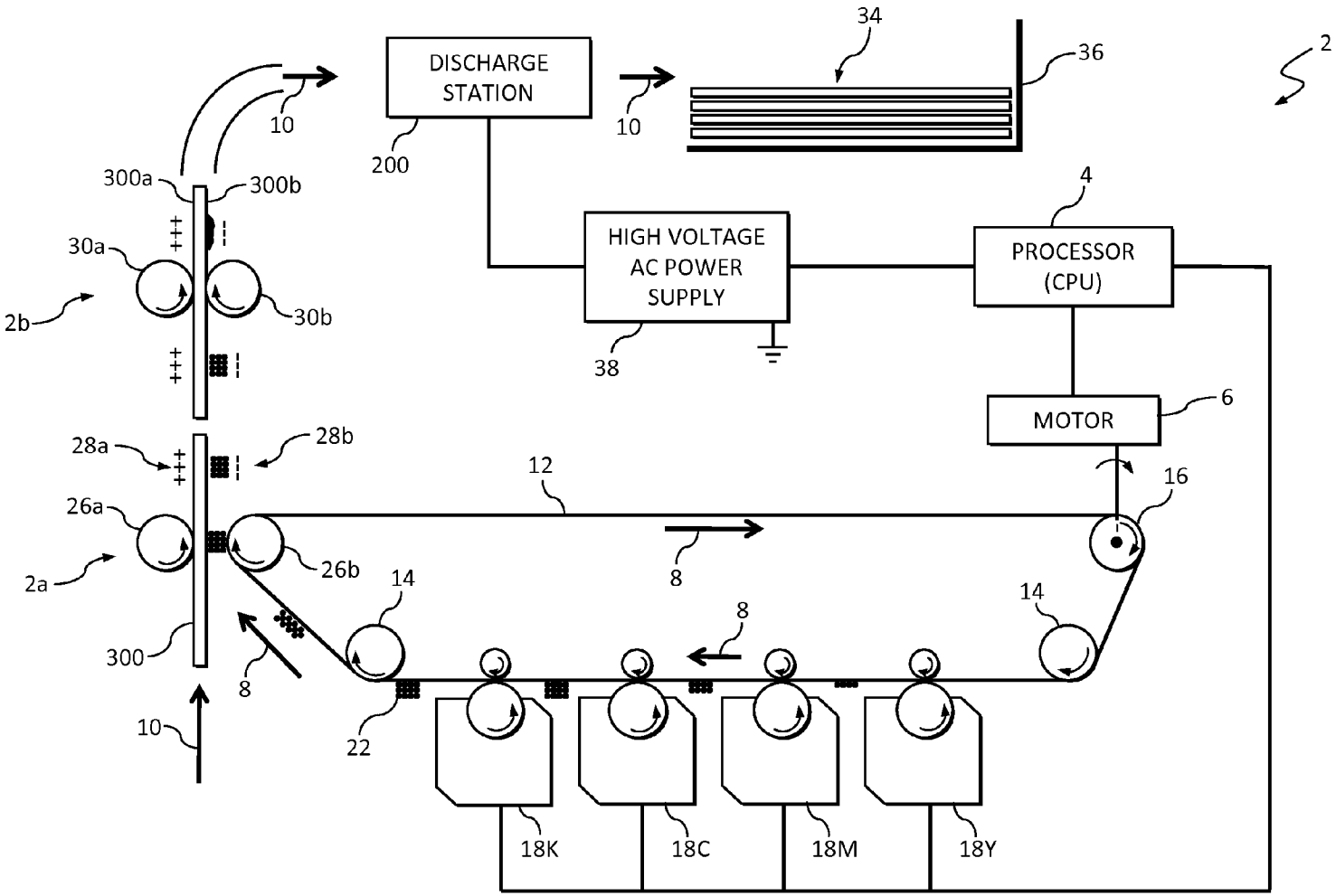
FIG. 1 is a schematic of an electrophotographic printer that is used in accordance with the invention to form a toned image on a sheet and stack such sheet.

Referring now to the FIG. 1, an electrophotographic (EP) printer 2 in accordance with the present invention is shown. The EP printer 2, includes a group of EP modules 18K, 18C, 18M, 18Y, a secondary transfer station 2*a*, a fusing station 2*b*, a discharge station 200, and a processor 4. The group of EP modules 18K, 18C, 18M, 18Y are conventional, and each contains a photoconductor for storing electrostatic charge, a charging device for depositing uniform electrostatic charge on the surface of the photoconductor, a light exposure device for creating an electrostatic latent image on the photoconductor in an image-wise fashion, and a development station for depositing toner onto the electrostatic latent image. The photoconductor for each EP module 18K, 18C, 18M, 18Y, is in nipped contact with an intermediate transfer member 12 via a backup roller for electrostatically transferring the toner from the photoconductor to the intermediate transfer member 12. The processor 4 provides necessary electrical signals to operate the EP modules 18K, 18C, 18M, 18Y, a high voltage AC power supply 38, and a motor 6. The motor 6 turns a drive roller 16, a set of nipped transfer rollers 26*a* and 26*b*, and a set of nipped fuser rollers 30*a* and 30*b*. A sheet 300 that can be used in accordance with the invention will be understood to be any receiver capable of receiving toner. In FIG. 1 sheet 300 is movable along a sheet path 10 defined by the nipped transfer rollers 26*a* and 26*b*, and the nipped fuser rollers 30*a* and 30*b*, graphically represented on FIG. 1 by the arrows labeled "10." A negatively charged toner 22 is transferred from the group of EP modules 18K, 18C, 18M, and 18Y to an intermediate transfer member 12 movable along a rotational transport path 8 defined by a roller 14, a drive roller 16, and the nipped transfer roller 26*b*, graphically represented on FIG. 1 by the arrows labeled "8."

The negatively charged toner 22 is then carried by the intermediate transfer member 12 to the secondary transfer station 2*a*. The negatively charged toner 22 is electrostatically transferred to the sheet 300 as it passes through the nipped transfer rollers 26*a* and 26*b*. As a result, a positive charge 28*a* and a negative charge 28*b* are present on opposite sides of the charged sheet 300. The charged sheet 300 is then passed through the fusing station 2*b* located after the secondary transfer station 2*a* and before the discharge station 200 along the sheet path 10. The fusing station 2*b* has a set of nipped fuser rollers 30*a* and 30*b*. The nipped fuser rollers 30*a* and 30*b* apply heat and pressure to the charged sheet 300 to fuse or fix the negatively charged toner 22 to the charged sheet 300. Upon exiting the fusing station 2*b*, the charged sheet 300 has an untoned side 300*a* and a toned side 300*b*.

The charged sheet 300 then passes through the discharge station 200 and an uncharged sheet 34 is stacked in the sheet hopper 36.

Figure 2:
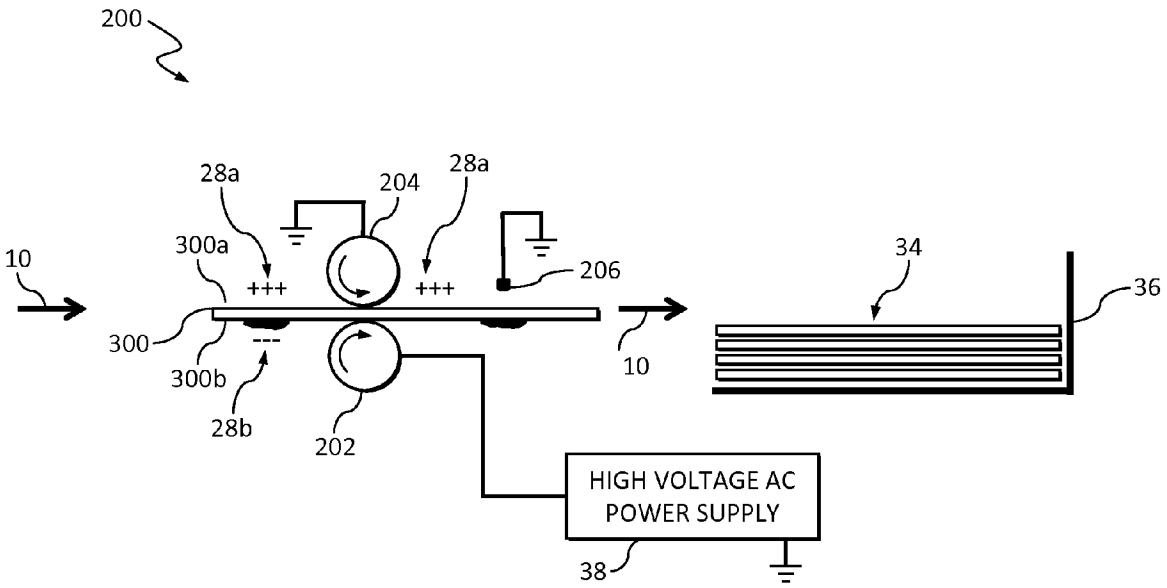
FIG. 2 is a detailed view of the discharge station shown in FIG. 1.

Referring now to FIG. 2, a discharge station 200 in accordance with the present invention is shown. The discharge station 200 includes a set of nipped discharge rollers 202 and 204, a non-contact charge removal device 206, and a high voltage AC power supply 38. The charged sheet 300, movable along the sheet path 10, has an untoned side 300*a* and a toned side 300*b* wherein the untoned side of the sheet 300*a* has a positive charge 28*a*, and the toned side of the sheet 300*b* has a negative charge 28*b*. The high voltage AC power supply 38 provides an AC voltage to the nipped discharge roller 202. Upon contact, the nipped discharge roller 202 substantially dissipates the negative charge 28*b* from the toned side of the sheet 300*b*, and the positive charge 28*a* substantially remains on the untoned side of the sheet 300*a*. The positive charge 28*a* is then substantially removed by a non-contact charge removal device 206 positioned after the nipped discharge rollers 202 and 204 along the sheet path 10. Once the positive charge 28*a* and the negative charge 28*b* are substantially removed from the charged sheet 300, the uncharged sheet 34 is stacked in a sheet hopper 36. The uncharged sheets 34 are free from bonding to the other sheets due to the elimination of the electrostatic charge.

Figure 3:
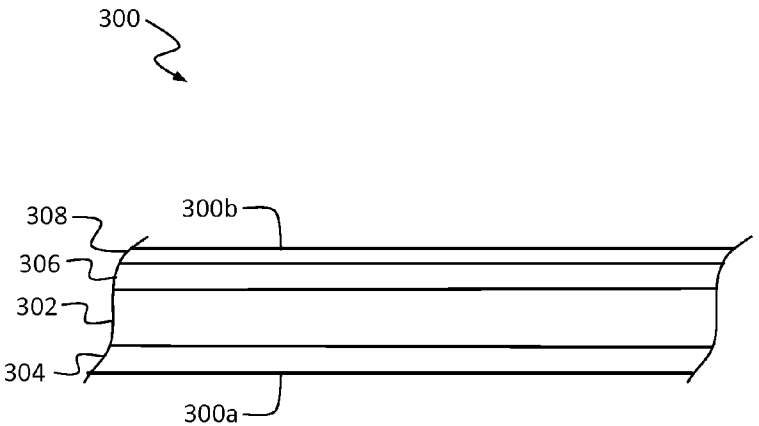
FIG. 3 is a cross-sectional view of a sheet that is used in accordance with the present invention.

In FIG. 3, a representative sheet 300 that is capable of receiving a charged image is shown for purposes of illustration. The sheet 300 includes at least one paper base layer 302 in combination with one or more polymer layers formed on one or both sides of the paper base layer 302. Alternatively, sheet 300 can include only polymeric material. One of the polymer layers includes a toner receiving layer 308. An example of another polymer layer is a moisture barrier layer 306. Additionally, the sheet 300 can include an anti-curl layer 304 for reducing curling of the sheet during the electrophotographic process.

Figure 4:
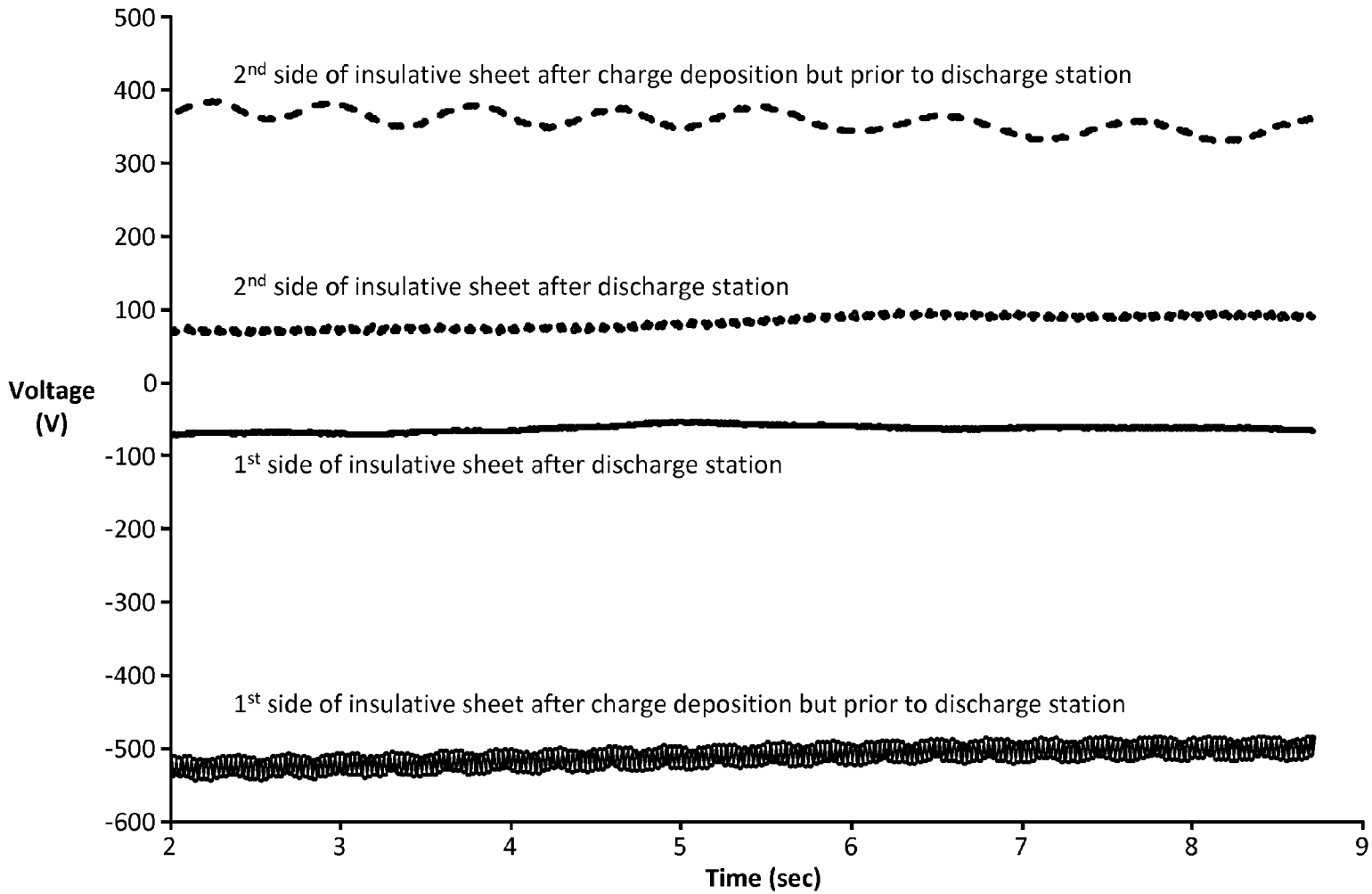
FIG. 4 is a graph depicting the results of applying a charge to a web and subsequently removing the charge from the web using a discharge station shown in detail in FIG. 2.

For a specific example, the results of which are illustrated in FIG. 4, an experiment was conducted with a roll of coated paper having an insulative polyethylene resin layer coated on either side of a raw paper base and a polyester toner receiver layer further coated onto the resin layer one side. This material is hereinafter referred to as an insulative sheet. The insulative sheet was unwound at nominally 100 mm/sec and subjected to a charge deposition apparatus so as to apply a controlled level of charge to both surfaces of the insulative sheet. Using a technique known to a person of ordinary skill in the art the charge deposited on either surface of the insulative sheet was measured using a non-contacting electrostatic voltmeter whereby the first side of the insulative sheet was conveyed around an electrically grounded bare metal roller and a non-contacting electrostatic voltmeter probe was located approximately 2 mm above the surface of the second side of the insulative sheet. The voltmeter probe capacitively couples with any surface charge so as to provide a measure of the charge deposited on the second side of the insulative sheet. This process is then repeated with the second side of the insulative sheet conveyed around a subsequent electrically grounded bare metal roller and the charge deposited on the first side of the insulative sheet was measured using another non-contacting electrostatic voltmeter probe.

Subsequently, the insulative sheet was conveyed between a set of nipped rollers. One of the nipped rollers was bare metal and electrically grounded. The opposite nipped roller had a metal core with an elastomeric covering, whereby the metal core was electrically connected to a high voltage alternating current (AC) power supply (equal to or exceeding 1 kV peak-to-peak amplitude). The roller having the AC voltage applied thereto was capable of removing charge residing on the side of the insulative sheet contacting the elastomeric roller.

Finally, the insulative sheet was conveyed past a non-contacting passive (electrically grounded) charge removal device. A non-conductive string containing stainless steel fibers sold commercially as StaticString™, was used as the non-contacting charge removal device. It was located a distance of 1 mm above the second side of the insulative sheet, thereby removing charge that resided on the second side of the insulative sheet. Other non-contacting devices such as conductive brushes, tinsel, or pin electrodes can also be used to effectively remove charge from one side of the sheet.

The results illustrated in FIG. 4 demonstrate the utility of this charge removal process in an actual example. After the charge deposition process prior to the discharge station 200, the first side of the insulative sheet had roughly −500V of charge and the second side of the insulative sheet had roughly 360V. The AC bias voltage applied to the elastomeric covered roller was a 4.8 kV peak amplitude, 100 Hz sinusoid. After passing through the discharge station, the charge on the first side was reduced to −65V and the charge on the second side was reduced to 81V, as shown in FIG. 4. A range from 2 kV to 12 kV peak-to-peak was experimentally tested and was successful in adequately removing charge from the insulative sheet.

The amplitude and frequency of the applied AC voltage signal required to appropriately remove the charge on a sheet can be determined experimentally. It will be understood that use of the term AC voltage signal is not limited to a sinusoidal wave, but will include other waveforms that vary in amplitude from one polarity to the opposite polarity such as square, trapezoidal, or triangular waveforms.

The useful range of frequencies of the AC voltage signal is related to the residence time of the sheet in the ionization zone of the nipped rollers and is directly proportional to the conveyance speed of the insulative sheet. The residence time ($\tau_{res}$) of the sheet is defined as the ratio of a characteristic length to the conveyance speed. The characteristic length will be defined by the length of a region in the sheet conveyance direction where air ionization takes place, typically in the post-nip region subsequent to the last point at which the sheet contacts the elastomeric roller. The characteristic length is typically on the order of 1 mm in length. For effective charge removal, the AC frequency should lie between ($1/\tau_{res}$) and ($10/\tau_{res}$). For example, for a characteristic length of 1 mm and a sheet conveyance speed of 100 mm/sec, $\tau_{res}$ equals 10 msec. Therefore, for this conveyance speed, the effective AC frequency should range between 100 Hz and 1000 Hz.

At least one of the nipped rollers has a static dissipative covering so as to control the uniformity of the ionization process. It is further desirable to have this covering be compliant so as to reduce the harmful effects of particulate contamination that might accumulate on the surface of the sheet or roller. Suitable static dissipative compliant coverings include polyurethane, silicone, or rubber materials containing conductive agents such as carbon, tin oxide or other conductive metal oxides, or conductive salts such as quaternary ammonium salts. Devices such as nipped blades or other surfaces that have static dissipative properties and could be in simultaneous sliding contact with the sheet can also effectively remove charge from a moving web, cylinder, or sheet. The sliding contact of such devices has the potential to cause undesirable damage to the sheet.

The invention has been described in detail with particular reference to certain preferred embodiments thereof, but it will be understood that variations and modifications can be effected within the spirit and scope of the invention.

PARTS LIST

2 Electrophotographic Printer
2*a* Secondary Transfer Station
2*b* Fusing Station
4 Processor
6 Motor
8 Rotational Transport Path
10 Sheet Path
12 Intermediate Transfer Member
14 Roller
16 Drive Roller
18K, 18C, 18M, 18Y Electrophotographic Modules
22 Negatively Charged Toner
26*a*, 26*b* Nipped Transfer Rollers
28*a* Positive Charge
28*b* Negative Charge
30*a*, 30*b* Nipped Fuser Rollers
34 Uncharged Sheet
36 Sheet Hopper
38 High Voltage AC Power Supply
200 Discharge Station
202 Nipped Discharge Roller
204 Nipped Discharge Roller
206 Non-Contact Charge Removal Device
300 Sheet
300*a* Untoned Side of Sheet
300*b* Toned Side of Sheet
302 Paper Base Layer
304 Anti-Curl Layer
306 Moisture Bather Layer
308 Toner Receiving Layer

The invention claimed is:

1. A method of removing charge from a charged sheet prior to stacking the charged sheet, comprising:

a) moving the charged sheet through a set of nipped rollers while a first roller has an AC voltage applied thereto so that a first side of the charged sheet is in contact with the first roller and has its charge substantially dissipated, whereby charge substantially remains on a second side of the charged sheet in contact with a second roller;

b) after step (a) using at least one non-contact charge removal device to remove charge from the second side of the charged sheet; and c) stacking the discharged sheet.

2. The method of claim 1 wherein the peak-to-peak amplitude of the AC voltage signal is in a range of 2 kV to 12 kV.

3. A method of forming a toned image on an insulative sheet and removing charge from the toned sheet prior to stacking the sheet, comprising:

a) transferring charged toner to the surface of a first side of the sheet so that the toned surface is at one polarity of charge and a second side of the sheet is at the opposite polarity of charge;

b) fusing the charged toner to the surface of the first side of the sheet;

c) moving the toned charged sheet through a set of nipped discharge rollers while a first roller has an AC voltage applied thereto so that one side of the sheet is in contact with the first roller and has its charge substantially dissipated, whereby charge substantially remains on the opposite side of the sheet in contact with a second roller;

d) after step (c) using at least one non-contact charge removal device to remove charge from the side of the sheet in contact with the second roller; and e) stacking the toned discharged sheet.

4. The method of claim 3 wherein the sheet includes at least one paper base layer and a first polymer layer formed on a paper base layer.

5. The method of claim 4 further including a second polymer layer formed on a side of the paper base layer opposite the side of the first polymer layer.

6. The method of claim 3 wherein the sheet includes a polymeric material.

7. The method of claim 3 wherein step (a) includes transferring the toner from an intermediate transfer member to the first side of the sheet.

8. The method of claim 3 wherein the peak-to-peak amplitude of the AC voltage signal is in a range of 2 kV to 12 kV.

9. A method of forming a toned image on an insulative sheet and removing charge from the toned sheet prior to stacking the sheet, comprising:

a) transferring charged toner to an intermediate transfer member;

b) moving the sheet along a sheet path through a set of nipped transfer rollers so that the charged toner is transferred from the intermediate transfer member to the surface of a first side of the sheet, and the toned surface is at one polarity of charge and a second side of the sheet is at the opposite polarity of charge;

c) moving the sheet and the charged toner along the sheet path through a set of nipped fuser rollers so that the charged toner is fused to the surface of the first side of the sheet;

d) moving the charged sheet along the sheet path through the set of nipped discharge rollers while a first roller has an AC voltage applied thereto so that one side of the sheet contacting the first roller has its charge substantially dissipated, whereby charge substantially remains on the opposite side of the sheet in contact with a second roller;

e) after step (d) using at least one non-contact charge removal device to remove charge from the side of the sheet in contact with the second roller; and f) stacking the discharged toned sheet.

10. The method of claim 9 wherein the sheet includes at least one paper base layer and a first polymer layer formed on a paper base layer.

11. The method of claim 10 wherein a second polymer layer formed on a side of the paper base layer opposite the side of the first polymer layer.

12. The method of claim 9 wherein the sheet includes a polymeric material.

13. The method of claim 9 wherein the peak-to-peak amplitude of the AC voltage signal is in a range of 2 kV to 12 kV.

* * * * *